US005195451A

United States Patent [19]

Nakashima

[11] Patent Number: 5,195,451

[45] Date of Patent: Mar. 23, 1993

[54] SEWING MACHINE PROVIDED WITH A PROJECTOR FOR PROJECTING THE IMAGE OF A STITCH PATTERN

[75] Inventor: Akifumi Nakashima, Ichinomiya, Japan

[73] Assignee: Broher Kogyo Kabushiki Kaisha, Nagoya, Japan

[21] Appl. No.: 874,090

[22] Filed: Apr. 27, 1992

[30] Foreign Application Priority Data

Jul. 12, 1991 [JP] Japan ..... 3-198766

[51] Int. Cl.[5] ..... D05B 21/00

[52] U.S. Cl. ..... 112/121.12; 112/445; 112/103; 112/262.3; 353/28

[58] Field of Search ..... 112/121.12, 103, 445, 112/121.11, 266.1, 262.3, 454, 456, 458; 353/28, 30, 35, 36

[56] References Cited

U.S. PATENT DOCUMENTS

| | | | |
|---|---|---|---|
| 4,341,170 | 7/1982 | Beckerman et al. | 112/445 X |
| 4,858,542 | 8/1989 | Kato et al. | 112/121.12 |
| 4,960,061 | 10/1990 | Tajima et al. | 112/445 X |
| 4,998,489 | 3/1991 | Hisatake et al. | 112/121.12 X |
| 5,042,410 | 8/1991 | Nakashima | 112/445 |
| 5,072,680 | 12/1991 | Nakashima | 112/445 |
| 5,107,778 | 4/1992 | Hisatake | 112/121.12 X |

FOREIGN PATENT DOCUMENTS 63-105787 5/1988 Japan .

63-197488 8/1988 Japan .

*Primary Examiner*—Peter Nerbun

*Attorney, Agent, or Firm*—Oliff & Berridge

[57] ABSTRACT

When a desired stitch pattern is selected by the operator, stitch pattern data representing the desired stitch pattern and image data representing the image of the stitch pattern to be projected on a workpiece are stored temporarily in a RAM. When the push button of a frame shifting switch is depressed, an embroidery frame holding the workpiece is shifted from a stitching area to an image projecting area. The image of the stitch pattern can be projected without being obstructed by the needle bar, the needle and the presser foot on the workpiece held by the embroidery frame placed in the image projecting area, so that the operator is able to confirm the stitch pattern to be formed easily and correctly. A projector projects the full-sized image of the stitch pattern on the basis of the image data read from the RAM on the workpiece held by the embroidery frame. The position of the embroidery frame relative to a reference position in the image projecting area can be changed by operating frame position adjusting switches to determine the position of the stitch pattern to be formed on the workpiece. The stitch pattern is formed on the workpiece at the position determined by operating the frame position adjusting switches in the image projecting area in forming the stitch pattern on the workpiece held by the embroidery frame placed in the stitching area.

20 Claims, 8 Drawing Sheets

Fig.3B

| ITEM | INSTRUCTIONS |
|---|---|
| 24 | EMBROIDERY FRAME |
| 26 | EMBROIDERY FRAME MOVING UNIT |
| 30 | STITCH PATTERN SELECTING UNIT |
| 32 | LIQUID CRYSTAL DISPLAY |
| 40 | MAIN MOTOR |
| 42 | PRESSER FOOT POSITION DETECTING SWITCH |
| 46 | S/S SWITCH |
| 50 | PROJECTOR ON/OFF SWITCH |
| 52 | FRAME SHIFTING SWITCH |
| 54 | FRAME POSITION ADJUSTING UNIT |
| 58 | LIGHT SOURCE |
| 60 | LIQUID CRYSTAL PANEL |
| 64 | DRIVING CIRCUIT |
| 66 | CPU |
| 68 | DRIVING CIRCUIT |
| 70 | DRIVING CIRCUIT |
| 72 | DRIVING CIRCUIT |
| 74 | TIMING SIGNAL GENERATING UNIT |
| 78 | STITCH PATTERN DATA |
| 80 | IMAGE DATA |
| 83 | CORRECTION DATA STORAGE AREA |

Fig.4B

| ITEM | INSTRUCTIONS |
|---|---|
| S102 | INITIALIZATION |
| S103 | STITCH PATTERN SELECTION |
| S104 | IS THE FRAME SHIFTING SWITCH CLOSED ? |
| S105 | IS THE PRESSER FOOT AT THE RETRACTED POSITION ? |
| S106 | SHIFT THE EMBROIDERY FRAME TO THE IMAGE PROJECTING AREA |
| S107 | IS THE PROJECTOR ON/OFF SWITCH CLOSED ? |
| S108 | TURN ON THE PROJECTOR |
| S109 | FRAME POSITION ADJUSTMENT AND STITCH PATTERN CHANGE |
| S114 | DISPLAY "PRESSER FOOT UP" |
| S115 | IS THE PUSH BUTTON OF THE FRAME SHIFTING SWITCH DEPRESSED AGAIN ? |
| S116 | SHIFT THE EMBROIDERY FRAME TO THE STITCHING AREA |
| S117 | IS THE S/S SWITCH CLOSED ? |
| S118 | IS THE PRESSER FOOT AT THE WORKING POSITION ? |
| S119 | DISPLAY "PRESSER FOOT DOWN" |
| S120 | START THE MAIN MOTOR |
| S121 | HAS THE STITCH PATTERN COMPLETED ? |
| S122 | IS THE PUSH BUTTON OF THE S/S SWITCH DEPRESSED AGAIN ? |
| S123 | STOP THE EMBROIDERY MACHINE |

Fig.5B

| ITEM | INSTRUCTIONS |
|---|---|
| S110 | IS THE PROJECTOR ON/OFF SWITCH CLOSED ? |
| S111 | IS THE PROJECTOR ON ? |
| S112 | TURN OFF THE PROJECTOR |
| S113 | TURN ON THE PROJECTOR |
| S124 | IS THE PUSH BUTTON OF THE FRAME SHIFTING SWITCH DEPRESSED AGAIN ? |
| S125 | IS THE PROJECTOR ON ? |
| S126 | TURN OFF THE PROJECTOR |
| S127 | SHIFT THE EMBROIDERY FRAME TO THE STITCHING AREA |

SEWING MACHINE PROVIDED WITH A PROJECTOR FOR PROJECTING THE IMAGE OF A STITCH PATTERN

BACKGROUND OF THE INVENTION

1. Field of the Invention

The present invention relates to a sewing machine provided with a projector for projecting the image of a desired stitch pattern on a workpiece to enable the confirmation of the desired stitch pattern and, more particularly, to a sewing machine provided with a projector and a workpiece holding means capable of shifting a workpiece between a stitching area and an image projecting area.

2. Description of the Related Art

Various sewing machines have been proposed which are capable of enabling the confirmation of a stitching starting position and the arrangement of a stitch pattern to be formed on a workpiece prior to starting stitching operation.

The applicant of the present patent application has previously proposed a sewing machine provided with a visual display, i.e., a CRT display, in Japanese Patent Laid-open No. 63-105787. The visual display of this prior sewing machine displays both a maximum stitching area and a stitching area, namely, an area to be covered by a desired stitch pattern, to enable the operator to confirm the stitch pattern.

A control system for controlling the operation of a computerized embroidery machine in the initial stage of operation is disclosed in Japanese Patent Laid-open No. 63-197488. This prior control system moves an embroidery frame without vertically moving the needle to enable the operator to confirm a stitching area on a workpiece held by the embroidery frame.

The sewing machine disclosed in Japanese Patent Laid-open No. 63-105787 displays both a maximum stitching area and a stitching area to be covered by a desired stitch pattern on the CRT display. Accordingly, the operator is able to estimate approximately the position of the stitch pattern on the workpiece relative to the embroidery frame. However, it is impossible to confirm the position of the stitch pattern accurately. For example, in forming a stitch pattern on a patterned workpiece or in additionally forming a stitch pattern on an embroidered workpiece, the accurate estimation of the position of the stitch pattern on the workpiece is difficult.

The control system for controlling the operation of a computerized embroidery machine in the initial stage of operation disclosed in Japanese Patent Laid-open No. 63-197488 enables the operator to decide if a desired pattern can be formed in an area defined by the embroidery frame. However, the control system is unable to enable the operator to confirm the position of the stitch pattern on the workpiece accurately, which is a problem similar to that residing in the sewing machine disclosed in Japanese Patent Laid-open No. 63-105787.

The applicant of the present patent application proposed a sewing machine capable of projecting the image of a stitch pattern in an area on the bed before the stitching point or on a workpiece placed on the bed in U.S. Ser. No. 07/602,699, now U.S. Pat. No. 5,072,680, which is not prior art. In this previously proposed sewing machine, a stitching area and an image projecting area are not demarcated exactly and the image of a stitch pattern is formed in an area before the stitching point to enable the operator to confirm a stitch pattern forming area on the workpiece accurately. However, this image projecting system cannot be applied without modification to an embroidery machine using an embroidery frame, because the stitching point at the start of stitching operation, in most cases, is in the central area of a stitching area on a workpiece defined by the embroidery frame, and hence the shadows of the presser foot, the presser bar, the needle bar and the needle, which are the essential components of the embroidery machine, fall on the projected image of a stitch pattern when the image of the stitch pattern is formed in an area before the stitching point. Therefore, the accurate confirmation of the stitch pattern is impossible and an effective image projecting area is limited to an area only on the feed side with respect to the presser foot and the needle bar. Accordingly, the accurate projection of the image of a stitch pattern is impossible if this known image projecting system is applied directly to the embroidery machine, which forms a stitch pattern in substantially the entire stitching area.

SUMMARY OF THE INVENTION

Accordingly, an object of the present invention is to enable the operator to confirm the position of a stitch pattern on a workpiece accurately and simply by forming the image of the stitch pattern in an image projecting area free from obstruction separate from a stitching area.

Another object of the present invention is to provide a sewing machine capable of projecting the image of a stitch pattern on a workpiece at an image projecting position in the entire stitching area defined by a workpiece holding means on a workpiece.

A further object of the present invention is to provide a sewing machine capable of stitching a stitch pattern in an area in which the image of a stitch pattern is formed when the workpiece is placed in an image projecting area.

A sewing machine capable of projecting the image of a stitch pattern in accordance with the present invention comprises stitch pattern data generating means for generating stitch pattern data representing stitch patterns to be formed selectively on a workpiece, a workpiece holding means for holding the workpiece, a needle, a stitch pattern forming means for moving the needle and the workpiece holding means relative to each other according to the stitch pattern data to form a stitch pattern on the workpiece, an image data storage means for storing image data corresponding to the stitch pattern data representing the stitch pattern, a workpiece holding means control means for controlling the workpiece holding means for movement between a stitching area where the stitch pattern is formed on the workpiece by the stitch pattern forming means and an image projecting area where the image of the stitch pattern is projected on the workpiece, and an image projecting means for projecting the image of the stitch pattern represented by the image data stored in the image data storage means on the workpiece held by the workpiece holding means.

When a desired stitch pattern is selected by the operator, the image projecting means reads image data corresponding to stitch pattern data representing the selected stitch pattern from the image data storage means. The workpiece holding means control means controls the workpiece holding means between a stitching position and an image projecting position. The image projecting means projects the full-sized image of the stitch pattern on the workpiece held by the workpiece holding means.

The sewing machine capable of projecting the image of a stitch pattern in accordance with the present invention projects the full-sized image of a desired stitch pattern on the workpiece held by the workpiece holding means positioned at the image projecting position separate from the stitching position and free from obstruction to the stitch pattern projection. Accordingly, the operator is able to confirm the position of the stitch pattern on the workpiece accurately and very easily. Furthermore, since the stitch pattern is formed in an area of the workpiece in which the image of the stitch pattern is formed with the workpiece holding means positioned at the image projecting position, the operator is able to determine a stitch pattern forming area optionally with the workpiece holding means positioned at the image projecting position.

BRIEF DESCRIPTION OF THE DRAWINGS

Preferred embodiments of the present invention will be described in detail with reference to the accompanying drawings, in which:

FIG. 3B is a chart corresponding to the block diagram of FIG. 3A;

FIG. 4B is a chart corresponding to the flow chart of FIG. 4A;

FIG. 5B is a chart corresponding to the flow chart of FIG. 5A.

DETAILED DESCRIPTION OF THE PREFERRED EMBODIMENTS

The present invention will be described hereinafter as applied to an embroidery machine provided with an embroidery frame capable of being moved between a stitching position and an image projecting position, and a projector for projecting the image of a desired stitch pattern.

Figure 1:
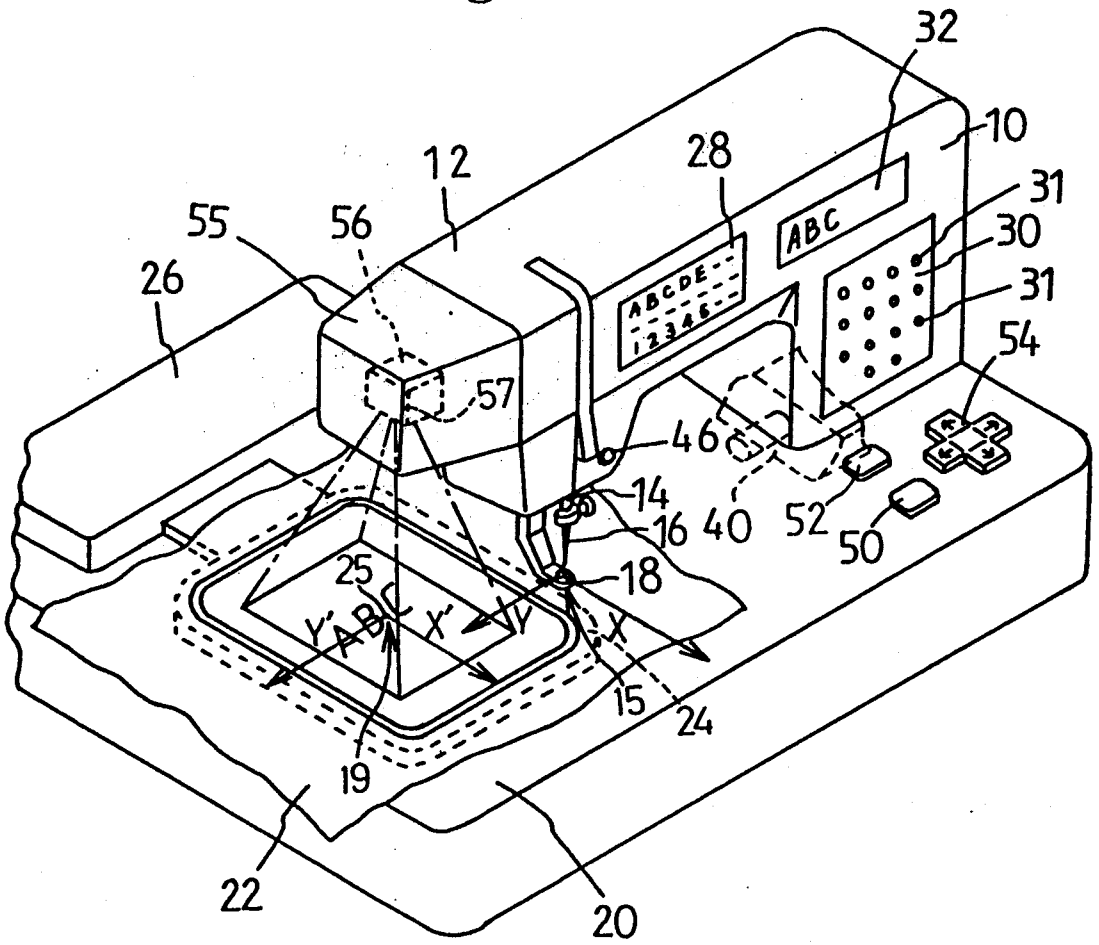
FIG. 1 is a perspective view of an embroidery machine in accordance with the present invention.

Referring to FIG. 1, a main body 10 is set on a bed 20. A needle bar 14 holding a needle 16 at its lower end projects downward from a head 12 of the main body 10. The needle bar 14 is reciprocated vertically by a main motor 40.

A presser bar is extended behind the needle bar 14 and a presser foot 18 is attached to the lower end of the presser bar. The presser foot 18 is lifted up to an upper retracted position to release a workpiece 22 and is lowered to a working position by operating a presser bar lifting lever. A presser foot position detecting switch 42 (FIG. 3) is closed when the presser foot 18 is lifted up to the retracted position and is opened when the presser foot 18 is lowered to the working position.

A known rotating hook complete, not shown, consisting of a rotating hook bobbin case holder and a rotating hook is disposed in the bed 20. The rotating hook complete and the needle 16 cooperate to embroider the workpiece 22 with a stitch pattern.

An embroidery frame 24, i.e., a workpiece holding means, for holding the workpiece 22 is placed on the bed 20. When the embroidery frame 24 is positioned at a reference image projecting position, the center 25 of the embroidery frame 24 coincides with a reference point 19 directly below the center 57 of a projector 56. The embroidery frame 24 is moved optionally in directions along an X-axis and a Y-axis by an embroidery frame moving unit 26. The embroidery frame moving unit 26 is provided with a pair of pulse motors, which are driven in synchronism with the vertical reciprocation of the needle 16 to move the embroidery frame 24 in directions along the X-axis and the Y-axis.

Provided on the front surface of the main body 10 are a pattern display 28 for displaying stitch patterns stored in a ROM 44 (FIG. 3), a pattern selecting unit 30 provided with a plurality of pattern selecting keys 31 for selecting a desired stitch pattern, and a liquid crystal display 32 for displaying a stitch pattern selected by operating the pattern selecting keys 31 and the pattern number of the selected stitch pattern. A start/stop switch (hereinafter referred to as "S/S switch") 46 for starting and stopping the embroidery machine is provided on the head 12.

Provided in the front part of the bed 20 are a projector ON/OFF switch 50 for turning on and off the projector 56, a frame shifting switch 52 for shifting the embroidery frame 24 between a stitching area and an image projecting area, and frame position adjusting switches 54 for adjusting the position of the embroidery frame 24 to determine a stitch pattern forming area. The frame position adjusting switches 54, which are similar to cursor move switches for moving a cursor on the screen of a display, are used for slightly shifting the embroidery frame 24 in desired directions. The S/S switch 46, the projector ON/OFF switch 50 and the frame position changing switch 52 are pushbutton switches which are closed and opened alternately when their push buttons are depressed repeatedly.

A projector housing 55 is attached to the left end of the head 12. The projector 56 is disposed within the projector housing 55 to project the image of a stitch pattern selected by operating the pattern selecting switch 31 on the workpiece 22 held by the embroidery frame 24. The position of the projector 56 in the projector housing 55 is determined so that the projection of the image of a stitch pattern is not obstructed by the needle bar 14, the needle 16 and the presser foot 18.

When the embroidery frame 24 is positioned at the reference image projecting position in the image projecting area, the center 25 of the embroidery frame 24 coincides with the reference point 19 directly below the center 57 of the projector 56. When the embroidery frame 24 is positioned at a reference stitching position in the stitching area, the center 25 of the embroidery frame 24 coincides with a stitching point 15. The embroidery frame moving unit 26 moves the embroidery frame 24 in directions along the X-axis and the Y-axis in the stitching area and in directions along an X'-axis and a Y'-axis in the image projecting area. When the embroidery frame 24 is positioned at the reference image projecting position in the image projecting area, the entire area defined by the embroidery frame 24 is included in the scope of image projection of the projector 56.

Figure 2:
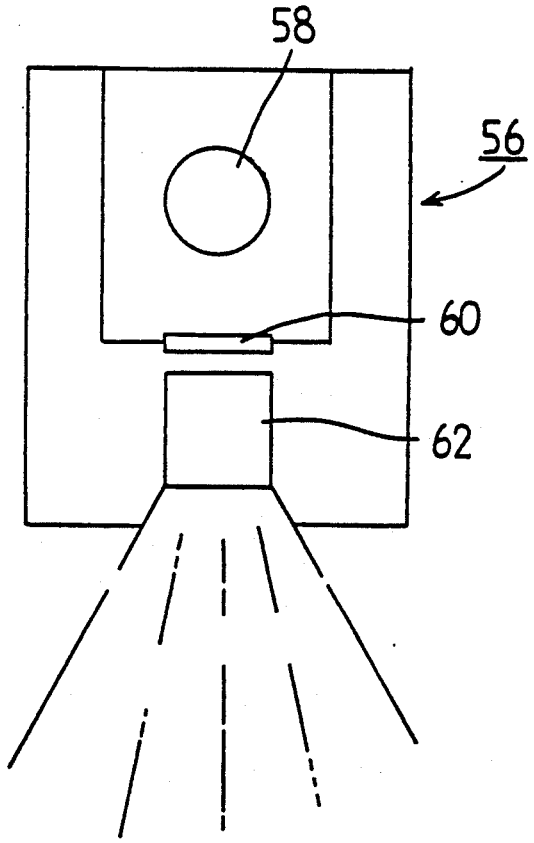
FIG. 2 is a schematic view of a projector.

As shown in FIG. 2, the projector 56 comprises, as principal components, a metal halide discharge lamp 58, a liquid crystal panel 60 for displaying an image corresponding image data representing a stitch pattern read from the ROM 44, and a focusing lens 62 for optically focusing light transmitted through the liquid crystal panel 60. A plurality of small shutters are driven for opening and closing by a shutter driving circuit 64 (FIG. 3) to form the image of a stitch pattern on the workpiece 22.

Light emitted by the light source 58 travels through the liquid crystal panel 60 and is focused on the surface of the workpiece 22 held by the embroidery frame 24 to form the image of a stitch pattern formed on the liquid crystal panel 60. The image focused on the workpiece 22 is formed in a size and in an orientation in which the stitch pattern is to be formed and at a position where the stitch pattern is to be formed on the workpiece 22.

Figure 3A:
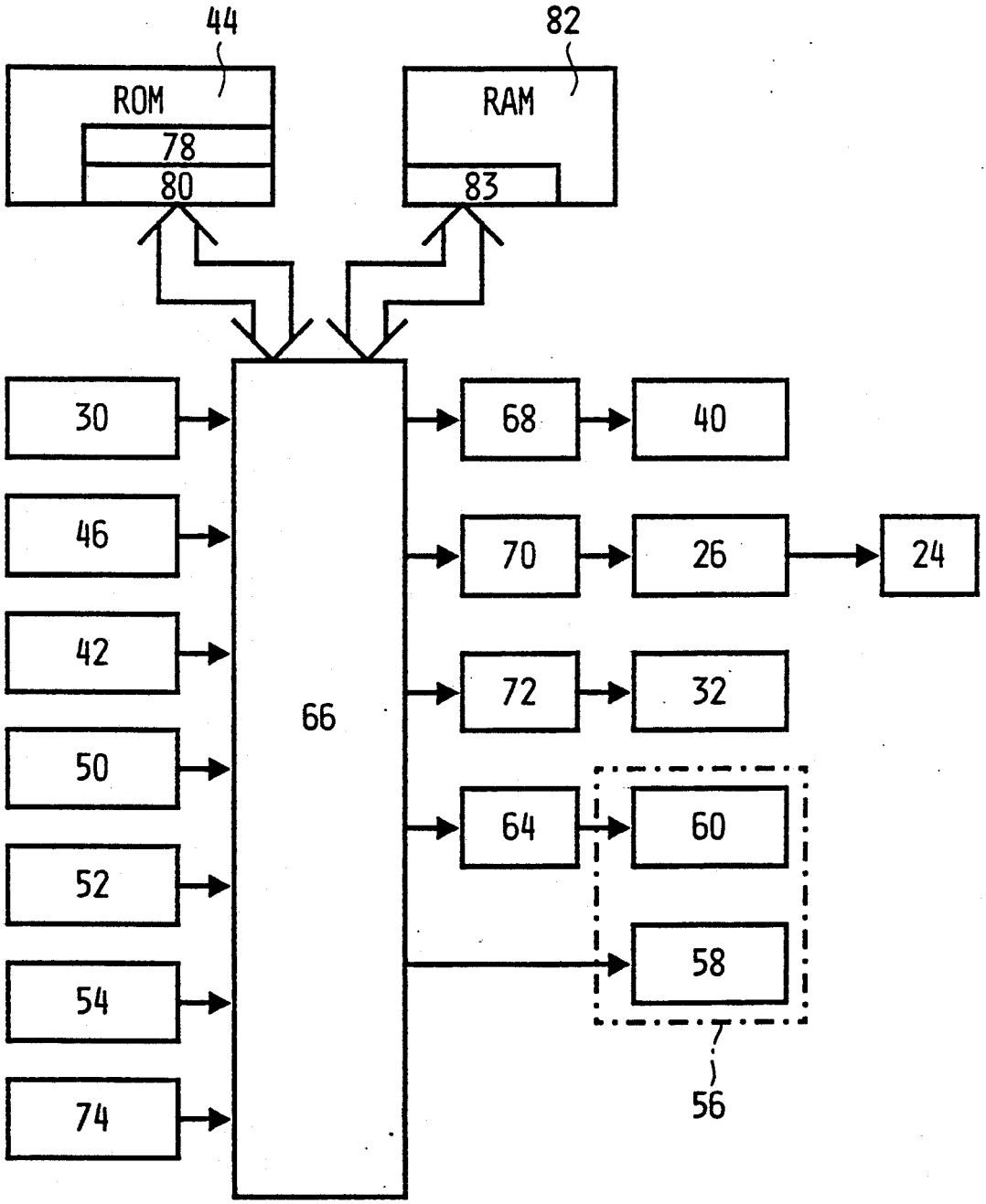
FIG. 3A is a block diagram of the control system of the embroidery machine of FIG. 1.

The control system of the embroidery machine will be described hereinafter with reference to FIG. 3. A central processing unit (hereinafter abbreviated to "CPU") 66 is the key component of the control system. The ROM 44 connected to the CPU 66 stores stitch pattern data 78 representing stitch patterns to be selected by the pattern selecting unit 30, image data 80 corresponding to the stitch pattern data 78, and control programs for controlling the operation of the embroidery machine.

The stitch pattern data 78 includes distances along the X-axis and the Y-axis of movement of the embroidery frame 24 from the reference stitching position of the workpiece holding frame 24 in the stitching area, and distances along the X'-axis and the Y'-axis of movement of the embroidery frame 24 from the reference image projecting position in the image projecting area. The reference stitching position in the stitching area corresponds to the reference image projecting position in the image projecting area, and hence the stitch pattern data 78 corresponds to the image data 80. That is, an image point (X1', Y'1) in the image projecting area corresponds to a stitch point (X1, Y1) in the stitching area.

A RAM 82 connected to the CPU 66 temporarily stores data read from the ROM 44 by the CPU 66. The RAM 82 has a correction data storage area 83 for storing correction data representing the distances of movement of the center 25 of the embroidery frame 24 from the reference image projecting position in the image projecting area along the X'-axis and the Y'-axis.

When the pattern selecting unit 30 connected to the CPU 66 is operated to select a desired stitch pattern, the pattern selecting unit 30 gives a code signal specifying the desired stitch pattern to the CPU 66. Then, the CPU 66 reads the stitch pattern data 78 and the image data 80 specified by the code signal and stores the same temporarily in the RAM 82.

After the desired stitch pattern has been selected by operating the pattern selecting unit 30, the CPU drives a liquid crystal display driving circuit 72 according to the image data 80 to display the desired stitch pattern on a liquid crystal display. The stitch pattern data 78 and the image data 80 are held in the RAM 82 until the next stitch pattern is selected. When the next stitch pattern selecting operation is executed, the contents of the RAM 82 are updated.

The projector ON/OFF switch 50, the frame shifting switch 52 and the frame position adjusting switches 54 are connected to the CPU 66. When the frame shifting switch 52 is closed, the CPU 66 actuates the driving circuit 70 to drive the embroidery frame moving unit 26. Then, the embroidery frame moving unit 26 shifts the embroidery frame 24 from the image projecting area to the stitching area or from the stitching area to the image projecting area.

When the frame position adjusting switches 54 are operated, the CPU 66 actuates the driving circuit 70 to drive the embroidery frame moving unit 26. Then, the embroidery frame moving unit 26 moves the embroidery frame 24 slightly along the X'-axis and the Y'-axis in the image projecting area to change the position of the embroidery frame 24. Thus, the position of the stitch pattern on the workpiece 22 is changed slightly and the stitch pattern data 78 is changed accordingly.

A timing signal generating unit 74 generates a timing signal for timing the synchronous operation of the main motor 40 and the embroidery frame moving unit 26 with the vertical reciprocation of the needle bar 14. Then, the CPU drives the main motor 40 and the embroidery frame moving unit 26 according to the timing signal.

When the projector ON/OFF switch 50 is closed, the CPU turns on the light source 58 and reads the image data 80 from the ROM 44 and actuates the driving circuit 64 to drive the liquid crystal panel 60 of the projector 56. Then, the projector 56 projects the image of the selected stitch pattern on the workpiece 22.

Figure 4A:
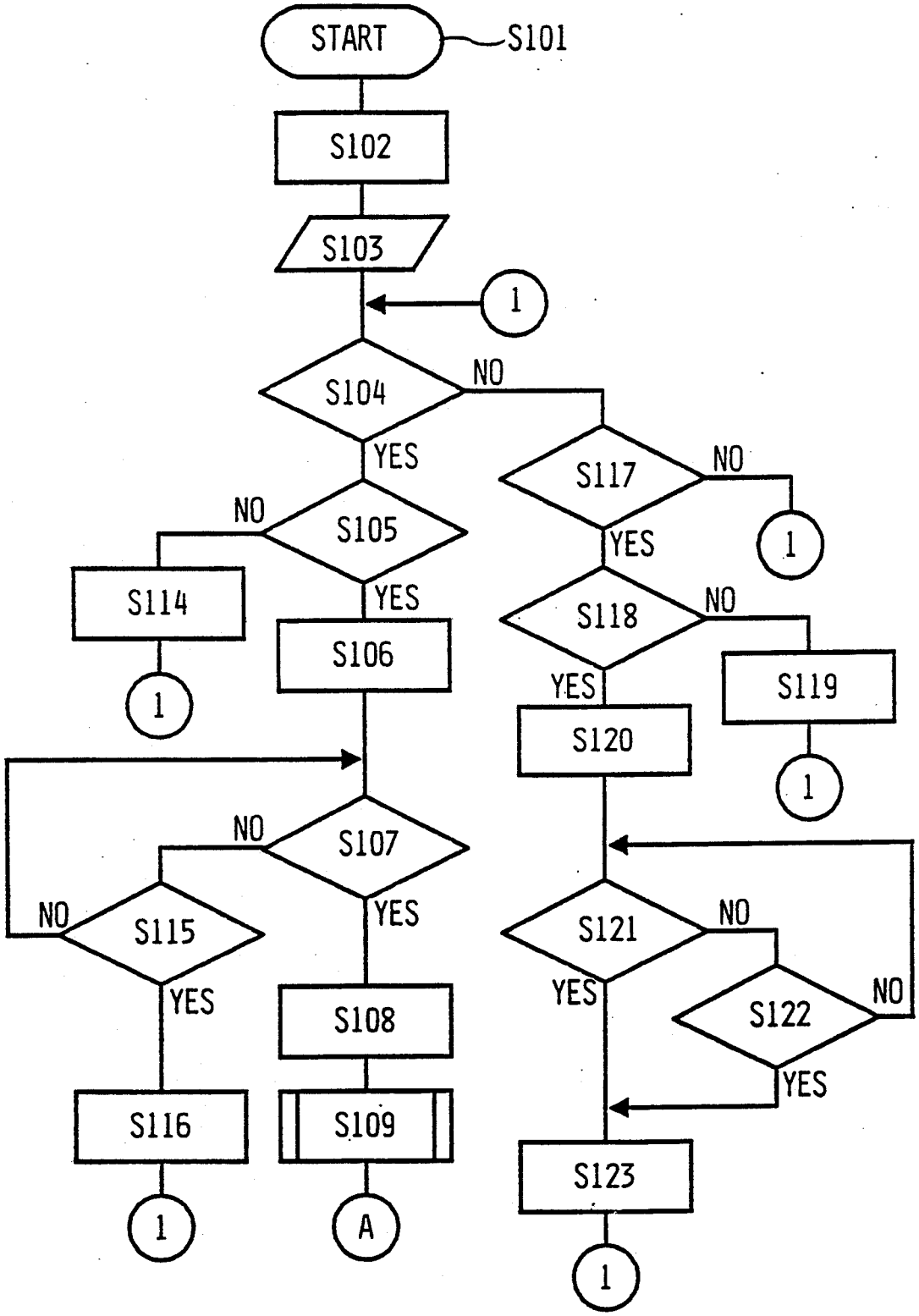
FIG. 4A is a flow chart explaining the operation of the embroidery machine of FIG. 1.

The operation of the embroidery machine thus constructed will be described hereinafter with reference to flow charts shown in FIGS. 4 and 5.

Upon the connection of the embroidery machine to the power source in step (hereinafter abbreviated to "S") 101, the embroidery sewing machine is initialized in S102, in which the embroidery frame 24 is positioned at the reference stitching position in the stitching area. In S103, a desired stitching pattern is selected by operating the pattern selecting keys 31 of the pattern selecting unit 30, and then, the CPU 66 makes a query in S104 to see if the push button of the frame shifting switch 52 is depressed.

If the response in S104 is affirmative, the CPU 66 decides in step S105 if the presser foot 18 is at the retracted position on the basis of a signal provided by the presser foot position detecting switch 42. If the decision in step S105 is negative, namely, if the presser foot 18 is not at the retracted position, a message "Presser foot up" is displayed on the liquid crystal display 32 in S114 to prompt the operator to raise the presser foot 18, because the embroidery frame 24 cannot be shifted from the stitching area to the image projecting area when the presser foot 18 is at the working position. Then, the CPU 66 returns to S104.

If the decision in step S105 is affirmative, namely, if the presser foot 18 is at the retracted position, the embroidery frame moving unit 26 shifts the embroidery frame from the reference stitching position in the stitching area to the reference image projecting position in the image projecting area in S106. Then, the CPU 66 makes a query in S107 to see if the projector ON/OFF switch 50 is closed.

If the response in S107 is affirmative, the projector 56 is turned on in S108. At the same time, the CPU 66 reads the image data 80 from the ROM 44 to make the projector 56 project the image of the selected stitch pattern. If a stitch pattern "A" is selected, an image "A" is projected on the workpiece 22 with its center coinciding with the center 25 of the embroidery frame 24. If a stitch pattern "ABC" is selected, an image "ABC" is projected on the workpiece 22 with the center of the image "B" coinciding with the center 25 of the embroidery frame 24.

In S109, the selected stitch pattern is confirmed and, if necessary, the frame position adjusting switches 54 are operated to adjust the position of the embroidery frame 24 relative to the image projected on the workpiece 22 by the embroidery frame moving unit 26. The center 25 of the embroidery frame 24 is shifted according to the movement of the embroidery frame 24. The distances of movement of the center 25 along the X'-axis and the Y'-axis in the image projecting area are stored in the correction data storage area of the RAM 82. When another stitch pattern is selected subsequently, the stitch pattern data 78 and the image data 80 stored in the RAM 82 are changed to correspond to the data of the new stitch pattern.

If the response in step 107 is negative, the CPU 66 executes S115 to make a query again to see if the frame shifting switch 52 is closed. If the response in S115 is negative, namely, if the frame shifting switch 52 is not closed, the CPU 66 returns to S107. Such a condition occurs when the embroidery frame 24 is shifted to the image projecting area to change the workpiece 22. If the response in S115 is affirmative, the embroidery frame moving unit 26 shifts the embroidery frame 24 to the stitching area, and then, the CPU 66 returns to S104.

If the response in S104 is negative, the CPU 66 makes a query in step S117 to see if the S/S switch 46 is closed. The CPU 66 returns to S104 when the response in S117 is negative or goes to S118 when the response in S117 is affirmative. In S118, the CPU 66 decides if the presser foot 18 is at the working position on the basis of a signal provided by the presser foot position detecting switch 42.

Since stitching operation is impossible when the presser foot is not at the working position, a message "Presser foot down" is displayed on the liquid crystal display 32 in S119 to prompt the operator to lower the presser foot 18 to the working position, and then, the CPU 66 returns to S104. If an affirmative decision is made in S118, the main motor 40 is actuated in S120 to start stitching operation. The CPU 66 makes a query in S121 to see if all the stitches represented by the stitch pattern data 78 have been formed. If the response in S121 is affirmative, the main motor 40 is stopped in S123.

If the response in S121 is negative, the CPU 66 makes a query to see if the push button of the S/S switch 46 is depressed again. If the response in S122 is affirmative, the main motor 40 is stopped in S123. If the response in S122 is negative, the CPU 66 returns to S121 to repeat the S121 and S122 until all the stitches represented by the stitch pattern data 78 are formed.

Even if the response in S122 is affirmative, namely, even if the push button of the S/S switch 46 is depressed again to stop the main motor 40, the projector 56 is able to project the image of the stitch pattern for stitch pattern confirmation. In such a case, the CPU 66 stores the stitch pattern data 78 of the stitch corresponding to the stitch point when the main motor 40 is stopped in the RAM 82, to control the embroidery frame moving unit 26, in shifting the embroidery frame 24 from the image projecting area to the stitching area, so as to return the embroidery frame 24 to a position where the embroidery frame 24 was positioned when the main motor 40 was stopped.

Figure 5A:
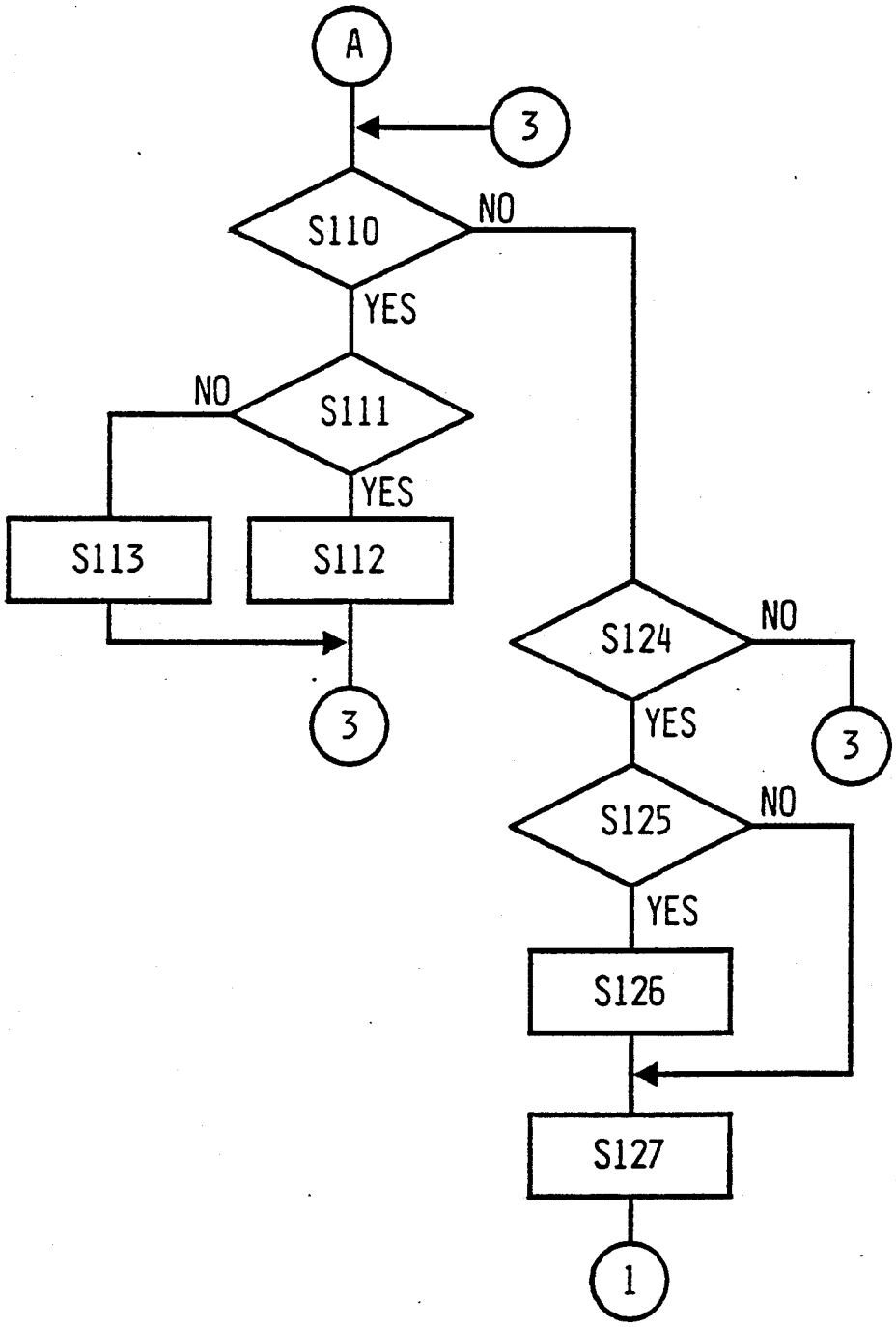
FIG. 5A is a flow chart continued fr ɔm the flow chart of FIG. 4A explaining the operation of the embroidery machine of FIG. 1.

Referring to FIG. 5A, after the completion of S109, namely, after the projector ON/OFF switch 50 has been closed and the positional adjustment of the embroidery frame 24 has been completed by operating the frame position adjusting switches 54, the CPU 66 makes a query in S110 to see if the push button of the projector ON/OFF switch is depressed again. If the response in S110 is affirmative, the CPU 66 makes a query in S111 to see if the projector 56 is ON and turns off the projector 56 in S112 when the response in S110 is affirmative. If the response in S111 is negative, the projector 56 is turned on in S113.

Then, the CPU 66 returns to S110 and turns on and off the projector 56 through S112 and S113 every time the push button of the projector ON/OFF switch 50 is depressed.

If the response in S110 is negative, the CPU 66 makes a query in S124 to see if the push button of the frame shifting switch 52 is depressed again to shift the embroidery frame 24 from the image projecting area to the stitching area. If the response in S124 is negative, the CPU 66 returns to S110. If the response in S124 is affirmative, the CPU 66 makes a query in S125 to see if the projector 56 is ON. If the response in S125 is affirmative, the projector 56 is turned off in S126. If the response in S125 is negative, the CPU 66 executes S127 to shift the embroidery frame 24 from the image projecting area to the stitching area by the embroidery frame moving unit 26. In shifting the embroidery frame 24 from the image projecting area to the stitching area the CPU 66 reads the correction data representing the distances of movement along the X'-axis and the Y'-axis of the center 25 of the embroidery frame 24 from the reference point 19 in the image projecting area from the correction data storage area 83 of the RAM 82 to control the embroidery frame moving unit 26 on the basis of the correction data to position the embroidery frame 25 in the stitching area with its center 25 shifted from the stitching point 15 by the distances represented by the data along the X-axis and the Y-axis. Thus, the embroidery frame 24 is positioned in the stitching area at a position corresponding to the position thereof in the image projecting area, so that the stitch pattern can be formed on the workpiece 22 at a position corresponding to the position of the image of the stitch pattern projected on the workpiece 22 with the embroidery frame 24 placed in the image projecting area. Then, the CPU 66 returns to S104.

As is apparent from the foregoing description, the embroidery frame 24 of the embroidery machine embodying the present invention can be shifted between the stitching area, and the image projecting area where the image of a stitch pattern can be projected on the workpiece 22 held by the embroidery frame 24 without being obstructed by the needle bar 14, the needle 16 and the presser foot 18 to enable the operator to confirm the stitch pattern easily and correctly from the image of the same projected on the workpiece 22 placed in the image projecting area. Since the position of the embroidery frame 24 relative to the reference point 19 can optionally be adjusted in the image projecting area to determine the position where the stitch pattern is to be formed on the workpiece, the stitch pattern can be formed exactly at a desired position on the workpiece 22.

Since the frame position adjusting switches 54 of the embroidery machine embodying the present invention enable the selective determination of a position where a stitch pattern is to be formed, the accurate confirmation of the stitch pattern is possible in forming the stitch pattern on a patterned workpiece or in additionally forming the stitch pattern on an embroidered workpiece.

Although the CPU 66 reads the image data 80 representing the image of a selected stitch pattern from the ROM 44 and the projector 56 projects the image of the stitch pattern on the workpiece 22 when the push button of the projector ON/OFF switch 50 is depressed in this embodiment, it is also possible, when the embroidery machine has a function to create stitch patterns, to produce image data 80 corresponding to stitch pattern data 78 representing a stitch pattern created by the embroidery machine and to project the image of the created stitch pattern.

Although the operation of the embroidery frame moving unit 26 for shifting the embroidery frame 24 is inhibited when the presser foot 18 is at the working position in this embodiment, the operation of the embroidery frame moving unit 26 may be controlled on the basis of the result of detection of the vertical position of the needle bar 14 to inhibit the operation of the embroidery frame moving unit 26 when the needle 16 has penetrated the workpiece 22.

What is claimed is:

1. A sewing machine capable of projecting the image of a stitch pattern on a workpiece, said sewing machine comprising:

a stitch pattern data storage means for storing stitch pattern data representing stitch patterns to be formed on the workpiece;

a workpiece holding means for holding the workpiece and defining a stitching area of the workpiece;

a stitch pattern forming means including a needle for forming a stitch pattern, on the basis of the stitch pattern data stored in said stitch pattern data storage means, on the workpiece held by said workpiece holding means placed in a stitching area of said sewing machine;

an image data storage means for storing image data corresponding to the stitch pattern data representing stitch patterns;

an image projecting means for projecting the image of a stitch pattern to be formed on the workpiece by said stitch pattern forming means, on the basis of the image data stored in said image data storage means, on the workpiece held by said workpiece holding means placed in an image projecting area of said sewing machine; and a workpiece moving means for moving said workpiece holding means between the stitching area of said sewing machine and the image projecting area.

2. A sewing machine according to claim 1, wherein said image projecting means projects the image of a stitch pattern in a scope which corresponds to the entire stitching area of the workpiece defined by said workpiece holding means.

3. A sewing machine according to claim 1 further comprising:

a stitch position adjusting means for adjusting, in the image projecting area, the position of a stitch pattern to be formed on the workpiece, wherein said workpiece moving means moves the workpiece holding means within the stitching area of said sewing machine on the basis of the position of the stitch pattern adjusted by said stitch position adjusting means.

4. A sewing machine according to claim 3 further comprising a stitch position storage means for storing the stitch position of the stitch pattern adjusted by said stitch position adjusting means.

5. A sewing machine according to claim 4, wherein said stitch position storage means stores data representing dislocation of said workpiece holding means from an initial image projecting position for said workpiece holding means relative to said image projecting means.

6. A sewing machine according to claim 5, wherein data representing the position of said workpiece holding means adjusted by said stitch position adjusting means relative to the initial image projecting position in the image projecting area is stored in said stitch position storage means.

7. A sewing machine according to claim 6, wherein said stitch position storage means stores data representing distances along perpendicular axes along which said workpiece holding means is shifted from the initial image projecting position in the image projecting area.

8. A sewing machine according to claim 1, wherein said workpiece holding means is located at an initial stitching position relative to the needle in the stitching area and at an initial image projecting position relative to said image projecting means in the image projecting area, wherein the stitch pattern data represents the dislocation of said workpiece holding means from the initial stitching position relative to the needle, and the image data represents dislocation of said workpiece holding means from the initial image projecting position relative to said image projecting means.

9. A sewing machine according to claim 8, wherein the stitch pattern data are distances by which said workpiece holding means is to be moved from the initial stitching position relative to the needle in forming the stitches of the stitch pattern represented by the stitch pattern data, and the image data are distances by which said workpiece holding means is to be moved from the initial image projecting position relative to said image projecting means.

10. A sewing machine according to claim 8, further comprising a stitch position adjusting means for adjusting the position of said workpiece holding means relative to said initial image projecting position in the image projecting area to determine the position of the stitch pattern on the workpiece.

11. A sewing machine capable of projecting the image of a stitch pattern on a workpiece, said sewing machine comprising:

a stitch pattern data generating means for generating stitch pattern data representing a stitch pattern to be formed on the workpiece;

a workpiece holding means for holding the workpiece having a holding frame defining a stitch pattern forming area;

an image data generating means for generating image data representing a stitch pattern;

an image projecting means for projecting the image of a stitch pattern on the basis of the image data generated by the image data generating means on an image projecting area;

a stitch forming means for forming a stitch pattern in the stitch pattern forming area on the workpiece in a stitching area of said sewing machine on the basis of the image of the stitch pattern projected by said image projecting means; and a moving means for moving said workpiece holding means between the stitching area of said sewing machine and the image projecting area.

12. A sewing machine according to claim 11, wherein said image projecting means is capable of projecting the image of a stitch pattern in the entire stitch pattern forming area.

13. A sewing machine according to claim 11 further comprising a stitch position adjusting means for adjusting, in the image projecting area, the position of a stitch pattern to be formed on the workpiece in the stitch pattern forming area, wherein said stitch forming means stitches the stitch pattern in the stitch pattern forming area on the workpiece in the stitching area of said sewing machine on the basis of the position of the stitch pattern adjusted by said stitch position adjusting means.

14. A sewing machine according to claim 13, wherein said stitch position adjusting means adjusts the position of said workpiece holding means with respect to a reference image projecting position in the image projecting area to determine a stitch pattern forming position at which the stitch pattern is to be formed on the workpiece in the stitch pattern forming area, and said stitch forming means forms the stitch pattern on the workpiece in the stitch pattern forming area at the stitch pattern forming position.

15. A sewing machine according to claim 11, further comprising a driving signal generating means for generating a signal for driving said moving means.

16. A sewing machine according to claim 11, further comprising a projecting signal generating means for generating a signal for making the image projecting means project the image of the stitch pattern on the workpiece in the stitch pattern forming area in the image projecting area.

17. A method of projecting the image of a stitch pattern on a workpiece held by a workpiece holding means, said method comprising steps of:

selecting a desired stitch pattern to be formed on the workpiece;

storing stitch pattern data representing the selected stitch pattern and image data representing the image of the selected stitch pattern to be projected on the workpiece;

moving the workpiece holding means holding the workpiece from a stitching area of said sewing machine, in which the workpiece holding means is placed while forming the stitch pattern, to an image projecting area, in which the workpiece holding means is placed while projecting the image of the stitch pattern on the workpiece; and projecting the full-sized image of the stitch pattern on the workpiece held by the workpiece holding means placed in the image projecting area, at a position on the workpiece where the stitch pattern is to be formed.

18. A method according to claim 17, further comprising steps of:

changing the position of the image of the stitch pattern on the workpiece held by the workpiece holding means placed in the image projecting area;

changing the stitch pattern data according to the change of the position of the image of the stitch pattern on the workpiece to provide changed stitch pattern data; and forming the stitch pattern on the workpiece held by the workpiece holding means placed in the stitching area of said sewing machine on the basis of the changed stitch pattern data.

19. A method according to claim 17, further comprising steps of:

selecting a second stitch pattern; and changing the stitch pattern data and the image data on the basis of the second selected stitch pattern.

20. A method according to claim 17, wherein the image of the stitch pattern is selectively projected on the workpiece at any position in the stitching area of the workpiece held by the workpiece holding means placed in the image projecting area during the step of projecting the image of the stitch pattern on the workpiece.

* * * * *